US010594114B2

(12) United States Patent
D'Acosta et al.

(10) Patent No.: US 10,594,114 B2
(45) Date of Patent: Mar. 17, 2020

(54) SPARK PLUG SIZE ADAPTOR ASSEMBLY

(71) Applicant: Swift Fuels, LLC, West Lafayette, IN (US)

(72) Inventors: Chris D'Acosta, West Lafayette, IN (US); Brian Stirm, Delphi, IN (US); Justin D. Zink, West Point, IN (US); Thomas Albuzat, Homburg (DE)

(73) Assignee: SWIFT FUELS, LLC, West Lafayette, IN (US)

( * ) Notice: Subject to any disclaimer, the term of this patent is extended or adjusted under 35 U.S.C. 154(b) by 0 days.

(21) Appl. No.: 15/989,710

(22) Filed: May 25, 2018

(65) Prior Publication Data

US 2018/0342855 A1 Nov. 29, 2018

Related U.S. Application Data

(60) Provisional application No. 62/511,388, filed on May 26, 2017.

(51) Int. Cl.
*H01T 13/08* (2006.01)
*H01T 13/46* (2006.01)

(52) U.S. Cl.
CPC ..... *H01T 13/08* (2013.01); *H01T 13/467* (2013.01)

(58) Field of Classification Search
CPC ..... H01T 13/05; H01T 13/04; H01T 13/06; H01T 13/41; H01T 13/08; H01T 13/34
See application file for complete search history.

(56) References Cited

U.S. PATENT DOCUMENTS

| | | | | |
|---|---|---|---|---|
| 2,069,046 | A * | 1/1937 | Rabezzana | H01T 13/05 174/397 |
| 4,497,532 | A * | 2/1985 | Bezusko | H01T 13/16 439/485 |
| 4,644,218 | A * | 2/1987 | Kirkhouse | H01T 13/54 313/120 |
| 5,842,458 | A * | 12/1998 | Alstrin | F02P 13/00 123/635 |
| 6,193,528 | B1 * | 2/2001 | Rea | H01R 13/639 123/169 PH |
| 8,716,923 | B2 * | 5/2014 | Mahon | H01T 13/08 313/121 |
| 10,008,830 | B2 * | 6/2018 | Marrs | H01T 13/04 |
| 2005/0056087 | A1 | 3/2005 | Kiess et al. | |
| 2008/0218053 | A1 * | 9/2008 | Callahan | H01T 13/06 313/143 |
| 2010/0001626 | A1 | 1/2010 | Maul et al. | |
| 2010/0301733 | A1 | 12/2010 | Kaiser et al. | |
| 2012/0267270 | A1 | 10/2012 | Iwami et al. | |
| 2015/0036255 | A1 | 2/2015 | Klein et al. | |

OTHER PUBLICATIONS

ISR_spark plug assembly WO2018218112, Nov. 2018 (Year: 2018).*

* cited by examiner

*Primary Examiner* — Tracie Y Green
(74) *Attorney, Agent, or Firm* — Woodard, Emhardt, Henry, Reeves & Wagner, LLP

(57) ABSTRACT

A spark plug assembly configured to allow multi-channel automotive spark-plugs to operate without radio-frequency interference in piston-engine powered aircraft and to greatly reduce or eliminate spark-plug fouling from carbon or lead deposits resulting from combustion of fuel in order to enhance starting and smooth operation of the aircraft engine, and thereby improve the quality of exhaust emissions by assuring a more complete burn of the fuel constituents.

4 Claims, 6 Drawing Sheets

SPARK PLUG SIZE ADAPTOR ASSEMBLY

CROSS-REFERENCE TO RELATED APPLICATION

This application claims the benefit of U.S. Provisional Application No. 62/511,388 filed May 26, 2017, which is hereby incorporated by reference.

BACKGROUND

Spark plugs deliver an electric spark into the combustion chamber of a spark-ignited piston engine. The internal combustion engine marketplace is froth with different types of spark plug configurations to serve a variety of functions. However, the spark plugs designed for piston-engine aircraft are particularly challenging due to the fact that bore sizes of the cylinder are generally larger (calling for 18 mm spark plugs) and each cylinder often utilizes 2 spark plugs, typically in a horizontally-opposed configuration, see FIG. 1.

Aviation spark plugs have a number of important attributes. For example, the barrel sizes vary between Size E—shielded ⅝ in. with 24 threads, and Size H—shielded ¾ in. with 20 threads. Aircraft mounting threads (18 mm)—include the following: Size B—with 13/16 in. reach and ⅞ in. hex; Size M—with ½ in. reach and ⅞ in. hex; and Size U—with 1⅛ in. reach and ⅞ in. hex. By comparison, automotive mounting threads (14 mm) have different sizes: Size J—with ⅜ in. reach and 13/16 in. hex; Size L—with ½ in. reach and 13/16 hex; and Size N—with ¾ in. reach and 13/16 hex.

The electrode design of a spark plug typically uses a conventional single center electrode with variations of one, two, three, four or more ground electrodes on a single plug. There are different design features (fine-wire, iridium, nickel, etc.) to evoke different sparking characteristics.

There have been hundreds of publications, periodicals and patent applications dealing with spark plug design and manufacture for use in automotive engines (e.g., Heywood, John. *Internal Combustion Engine Fundamentals*. McGraw-Hill, 1988 and Schwaller, Anthony, *Motor Automotive Mechanics*. Delmar Publishers, 1988). Notable among the patent field are those that reference the suppression of radio-frequency electromagnetic interference (e.g. U.S. Pat. Nos. 4,713,582 and 4,568,855) and the use of unique electrode designs (e.g., U.S. Pat. Nos. 6,091,185, 7,309,951 and 7,528,534) that offer more chances for the electric impulse in the piston engine to spark with resistance to fouling. However, none of the references are targeted at the unique challenges of the aircraft piston engine, which has more complexity and dimensional aspects that nullify inventions of the past.

Internal combustion engines in piston aircraft differ greatly from those in automobiles. Automobiles utilize a high rpm transmission with a gear reduction system, where piston aircraft do not have a transmission but instead have a much larger crankshaft and thrust bearings to directly rotate the propeller. As a result, aircraft cylinders are larger and the rpms are lower for aircraft engines.

Automobiles utilize water-cooled cylinders which are maintained at a constant temperature for stable operation, whereas piston aircraft cylinders are air-cooled by the inflow of outside air controlled by the pilot's throttle and airspeed. Detonation will occur in the aircraft engine when the cylinder gets too hot, which can be impacted by high outside air temperature and/or slow speeds at too high a deck angle. Certain pilot operating conditions may not lend themselves to lowering the angle of ascent, which is why either cooling the inlet air, cooling the cylinder, or increasing the octane of the fuel is critical to prevent detonation. Accordingly, many automotive spark plugs do not perform to the requirements of an aircraft engine.

It is also noteworthy that automobile engines are now highly automated whereby the air-to-fuel ratio is maintained at a constant level, adjusted for octane. By comparison, piston aircraft are operated manually at rich and lean mixture configurations subject to pilot discretion. This fact contributes greatly to the existence of combustion fouling from carbon, lead, etc. in aircraft engines when the fuel mixture is momentarily too rich and forms unwanted deposits on spark plugs.

Automobiles are generally operated up to about 30% of their rated power, whereas piston aircraft are generally operated above 75% of their rated power. This infers that piston aircraft are much more vulnerable to detonation incidents because full power is needed at take-off, while cross-country cruise is generally at about 75% power. Accordingly, there are few options to safely lessen the load on the aircraft engine at full power during take-off to avoid detonation. Having a clean spark and unfouled plugs becomes a vital safety issue in an aircraft.

Automobiles use smaller spark plugs with a typical bore size of 2" to 4", while most piston aircraft use larger horizontally-opposed spark plugs (2 in each cylinder) with bore sizes between 3" to 6". Automobiles have engine rotation speeds ranging from 0-7,000 rpm but rarely operate above ⅓ the maximum rpm available. However, piston aircraft typically have a maximum rotation up to about 2,800 rpm and often operate at or near this maximum a high percentage of the time while in flight. This high rpm activity in propeller aircraft is intensified by the electronic pulse of the piston which can cause electromagnetic interference which can disrupt pilot radio signals and navigational systems—creating a dangerous condition in flight.

In the last several decades the compression ratio of most automotive engines, measuring the ratio of the max vs. min volume in the cylinder has ranged between 9:1 to as high as 14:1. Such ratios on high performance aircraft are lower, typically ranging between 7.5:1 up to 9:1 (with naturally aspirated engines having ratios the higher end and turbocharged engines at the lower end.)

All these factors and more impact the way fuel is combusted and pre-mature engine detonation (knock) is controlled. This is particularly the case when adding the complexity in aircraft at high altitudes needing low vapor pressure gasoline with very high octane levels to sustain peak performance.

SUMMARY OF THE INVENTION

Disclosed is a spark plug assembly for a spark plug having an external thread at one end and a terminal at the opposite end, the spark plug further including a hexagonal flange for use in rotating the spark plug to insert or remove the spark plug and a top insulator positioned between the hexagonal flange and the terminal. The assembly includes a housing comprising a sleeve having a first end defining an external thread sized and configured to couple with an ignition harness of a spark-ignited aircraft engine, and a second end defining a hexagonal-shaped cavity sized and configured to receive the hexagonal flange of the spark plug. Upon assembly, the top insulator and terminal of the spark plug are received within the sleeve and the hexagonal flange of the spark plug is received within the hexagonal-shaped cavity of the housing.

The housing further defines an external hexagonal flange for use in securing the housing to the spark plug port of an aircraft engine. A coupling is secured to the housing and includes an internal thread configured to receive the external thread of the spark plug, the external thread of the spark plug being threadingly received within the internal thread of the coupling. The coupling further includes an external thread configured to be received by the spark plug port of the aircraft engine. An insulator is received within the sleeve and surrounds the top insulator of the spark plug.

DESCRIPTION

Described herein is a new approach to spark ignition in an internal combustion engine that improves the precision, reliability and firing impact of the spark in igniting industry-approved gasolines that meet international fuel standards (e.g. ASTM, ISO, GOST, etc.) in any piston-engine aircraft. This invention allows, for example, a uniquely specific 14 mm multi-channel (preferring the 4-electrode) automotive spark plug to be installed into an 18 mm piston aircraft cylinder using a durable shielded housing particularly designed for aircraft use. The design of this invention insulates and dampens sound waves and thereby eliminates electromagnetic interference.

The disclosed spark plug assembly reduces or eliminates any risk of carbon or lead fouling impacting the function of the spark-plug. The invention has applicability beyond aviation engines and is thereby adaptable to different sized cylinder ports, but the preferred embodiment of this unique assembly is tailored to an 18 mm cylinder port of a horizontally-opposed aircraft engine.

Figure 1:
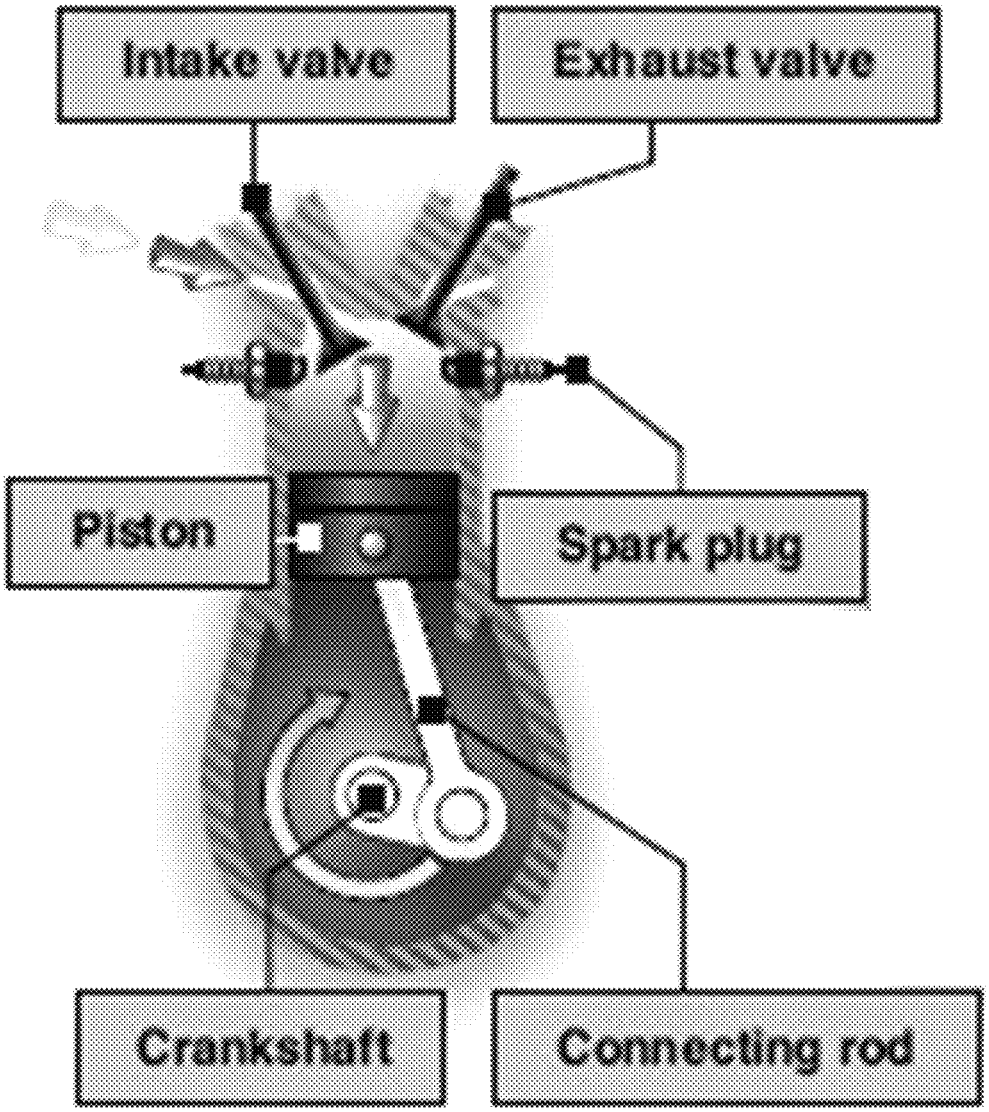
FIG. 1 is a diagram showing the conventional components of a piston and associated components for an aircraft engine.
Figure 2:
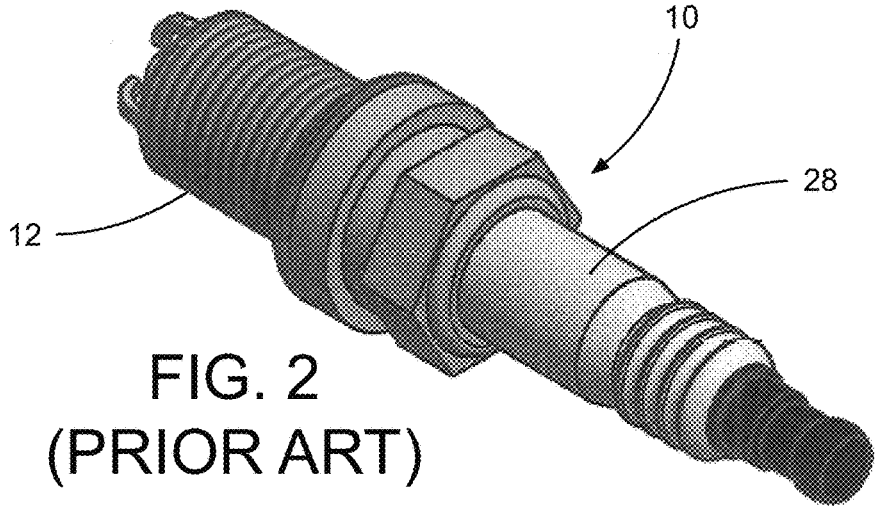
FIG. 2 (PRIOR ART)
FIG. 2 is a perspective of a conventional spark plug as used herein.
Figure 3:
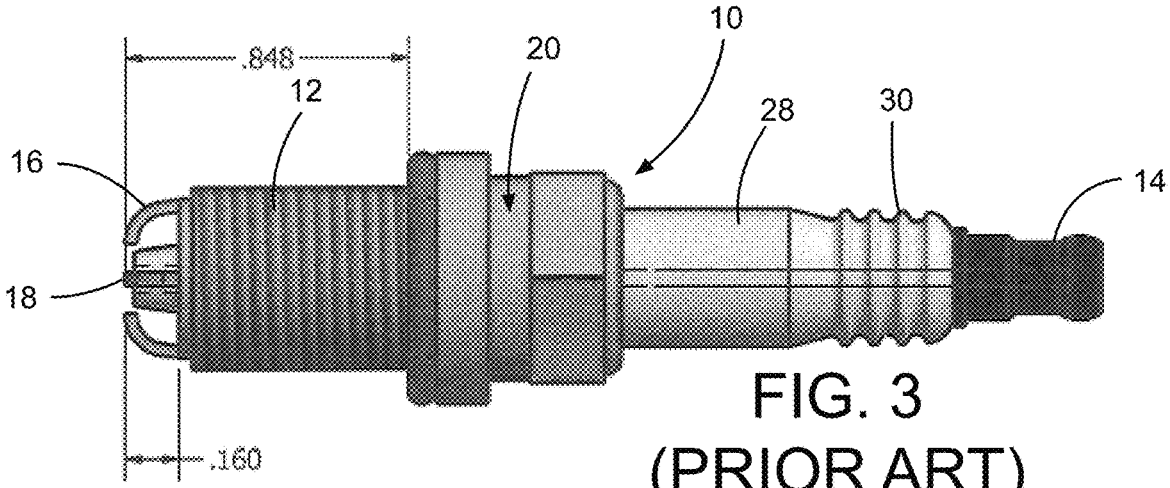
FIG. 3 (PRIOR ART)
FIG. 3 is a side view of a conventional spark plug as used herein.
Figure 4:
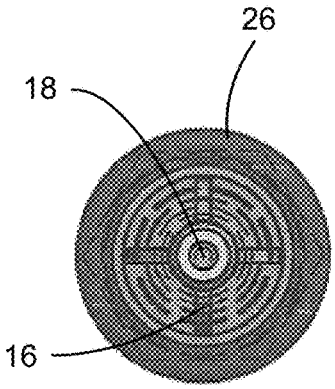
FIG. 4 (PRIOR ART)
FIG. 4 is a first end view of a conventional spark plug as used herein.
Figure 5:
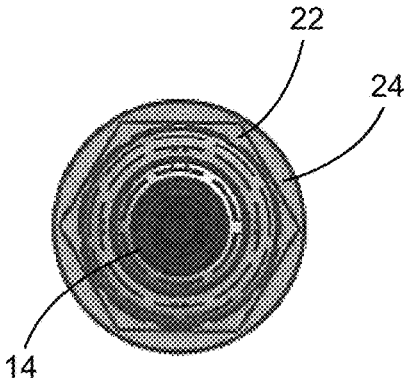
FIG. 5 (PRIOR ART)
FIG. 5 is a second end view of a conventional spark plug as used herein.

Referring to FIGS. 2-5, there is shown a typical spark plug 10 as known in the prior art. Spark plug 10 has the conventional components including an externally-threaded end 12 configured to be received by a spark-driven engine, and a terminal nut 14 for attachment to a wiring harness. At least one ground electrode 16 is positioned adjacent to a center electrode 18 forming an electrode gap therebetween. Shown in FIG. 4 is a spark plug with four ground electrodes. A metal shell 20 surrounds the middle portion of spark plug 10 and includes a hexagonal flange 22 for use in rotating the spark plug to insert or remove the spark plug from an engine. Spark plug 10 further includes a circular flange 24, which may receive a gasket 26 for sealing with the engine when mounted thereto. Between hexagonal flange 22 and terminal nut 14 is a top insulator 28 including corrugations 30.

The spark plug assembly 32 (FIG. 6) includes spark plug 10 as well as several other components. In combination, the assembly provides a system adapting a conventional automotive spark plug for use in an aircraft engine. In particular, the spark plug assembly adapts the automotive spark plug by providing an external thread at one end sized and configured to couple with an ignition harness of a spark-ignited aircraft engine, as well as an external thread on the other end sized and configured to be received by the cylinder part of an aircraft engine.

Figure 6:
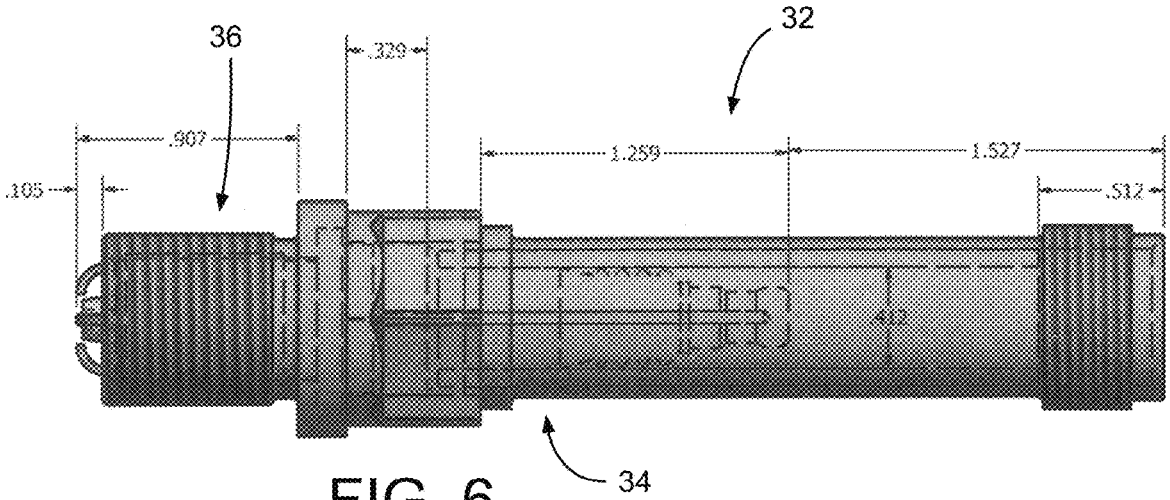
FIG. 6 is an elevational view of an illustrative embodiment of a spark plug assembly.

Spark plug assembly 32 is shown in assembled form in FIG. 6. Spark plug assembly 32 includes spark plug 10, as well as housing 34 and coupling 36. The structure and function of the several components are discussed separately.

Housing 34 may comprise one or more components secured together. Described herein is an embodiment in which housing 34 comprises two separate components with sleeve 38 secured to hex adapter 40. It will be appreciated, however, that these components may instead be fabricated as a single component.

Figure 7:
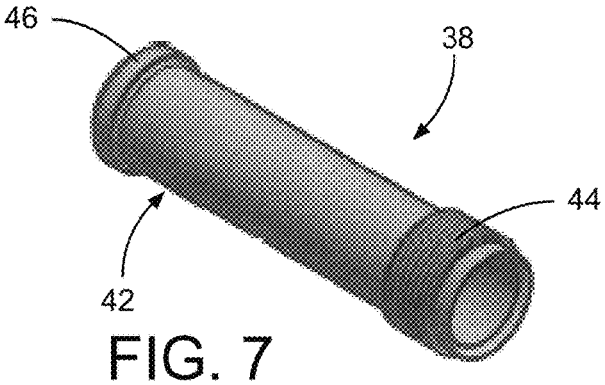
FIG. 7 is a perspective view of an illustrative embodiment of a sleeve for receiving a portion of a spark plug as disclosed herein.
Figure 9:
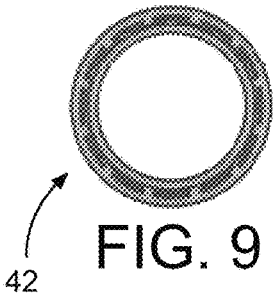
FIG. 9 is a first end elevational view of the sleeve of FIG. 7.
Figure 8:
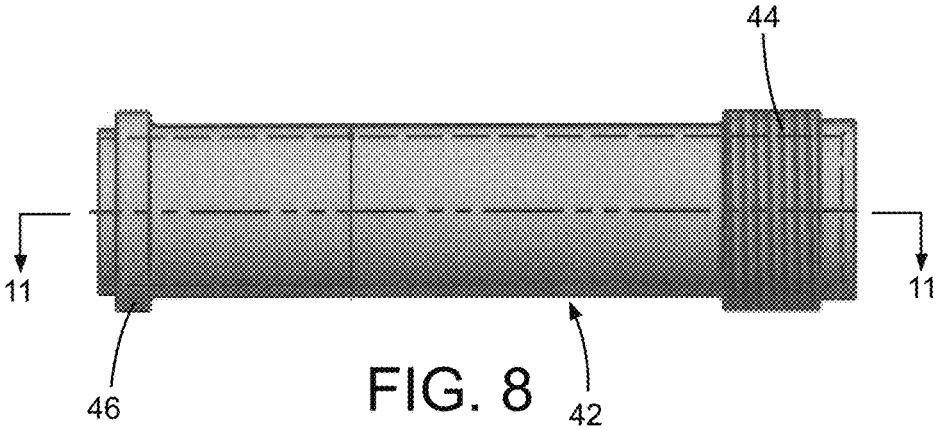
FIG. 8 is a side elevational view of the sleeve of FIG. 7.
Figure 10:
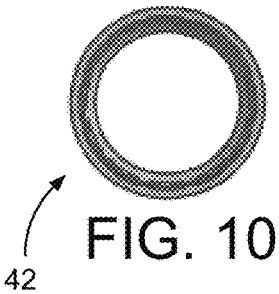
FIG. 10 is a second end elevational view of the sleeve of FIG. 7.
Figure 11:
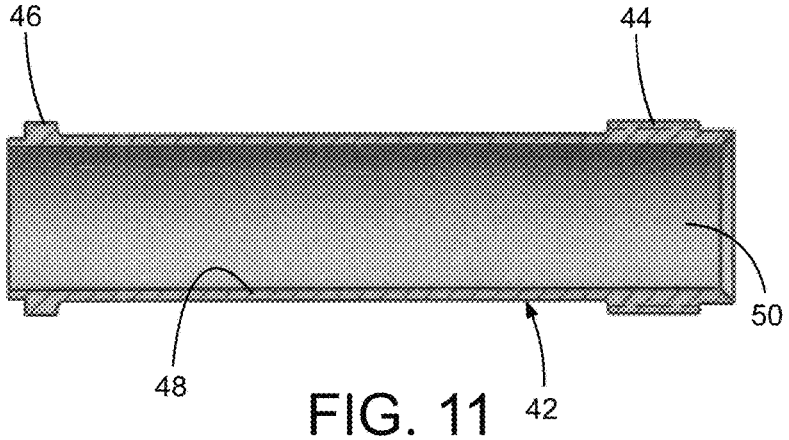
FIG. 11 is a cross-sectional view of the sleeve of FIG. 7.

Referring to FIGS. 7-11, there are shown various views of an exemplary embodiment of sleeve 38. FIG. 7 provides a perspective view of sleeve 38, while FIGS. 8-10 show side, first end, and second end elevational views, respectively, of sleeve 38. FIG. 11 is a cross-sectional view of sleeve 38. Sleeve 38 comprises an elongated, cylindrical member 42. Member 42 has a first end defining an external thread 44 configured to couple with an ignition harness of a spark-ignited aircraft engine. Member 42 has a second end including a flange 46. The interior surface 48 of member 42 defines an interior chamber sized to receive portions of spark plug 10 therein.

Figure 12:
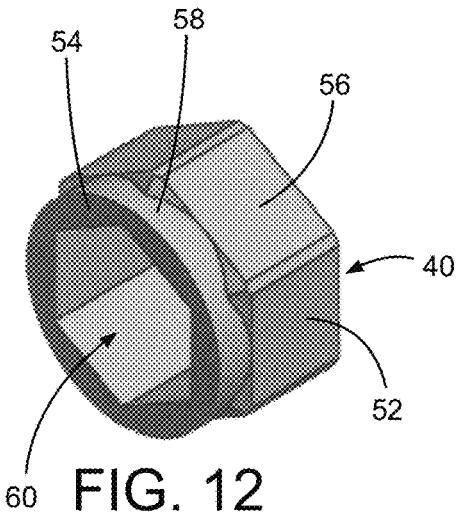
FIG. 12 is a perspective view of an illustrative embodiment of a hex adapter as disclosed herein.
Figure 13:
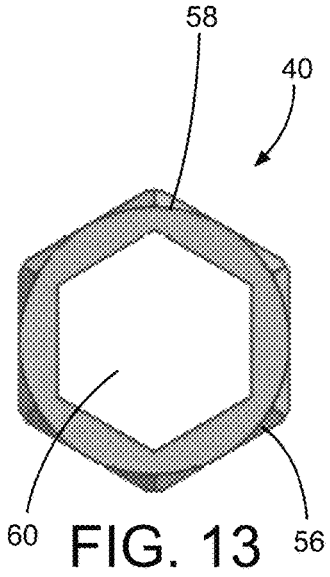
FIG. 13 is a second end view of the hex adapter of FIG. 12.
Figure 14:
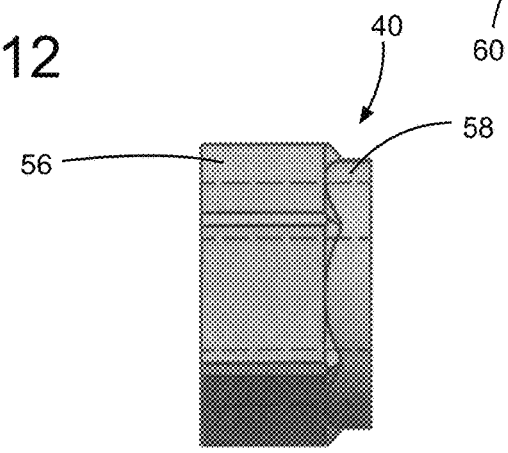
FIG. 14 is a side view of the hex adapter of FIG. 12.

An illustrative hex adapter 40 is shown in perspective, second end and left side views, respectively, in FIGS. 12-14. As shown in FIG. 12, hex adapter 40 includes a first end portion 52 and a second end portion 54. First end portion 52 defines an external hexagonal flange 56 for use in securing housing 34 to the aircraft engine. Second end portion 54 has a cylindrical outer surface 58. Hex adapter 40 includes a through-hole defining a hexagonal-shaped cavity 60 configured to receive the hexagonal flange 22 of spark plug 10.

In the spark plug assembly, hex adapter 40 is secured to the end of member 42 opposite the external thread 44, with the first end portion 52 adjacent to member 42. In this combination, member 42 and hex adapter 40 constitute housing 34. In a preferred embodiment the attachment is by welding and is sufficient to provide a strong, sealed assembly. Also in the spark plug assembly, spark plug 10 is positioned with hexagonal flange 22 of spark plug 10 received within hexagonal cavity 60 to secure the two components against relative rotation.

Figure 15:
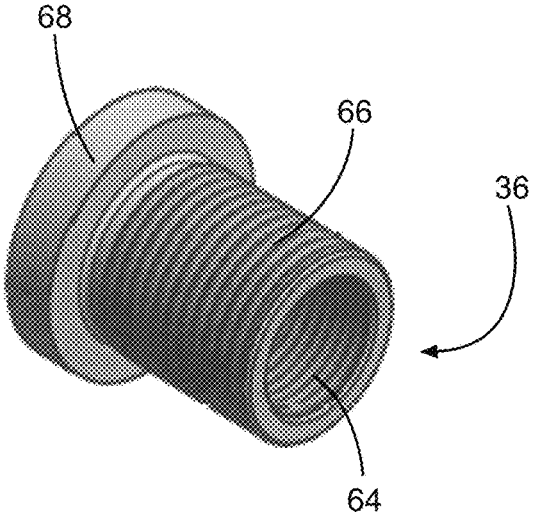
FIG. 15 is a perspective view of an illustrative embodiment of a coupling as disclosed herein.
Figure 16:
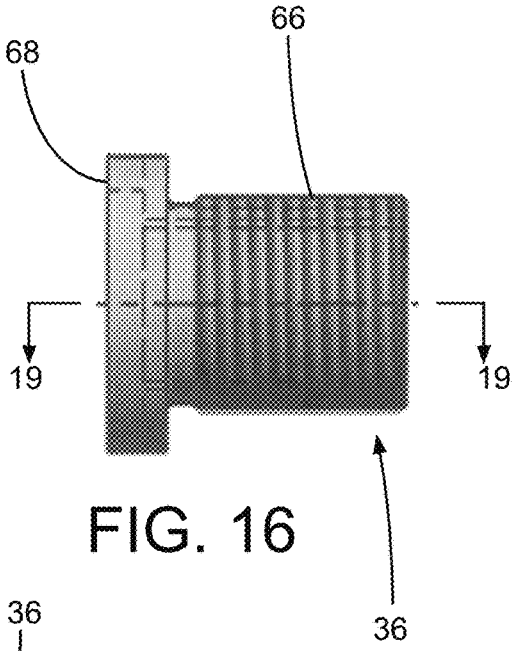
FIG. 16 is a side view of the coupling of FIG. 15.
Figure 17:
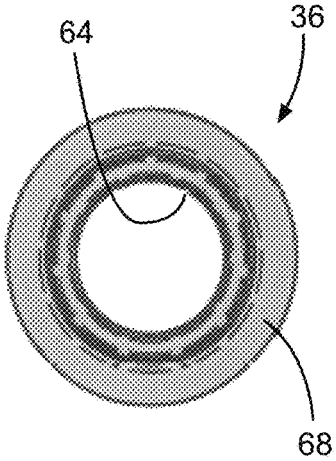
FIG. 17 is a first end view of the coupling of FIG. 15.
Figure 18:
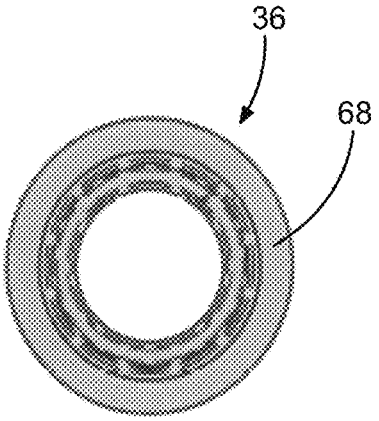
FIG. 18 is a second end view of the coupling of FIG. 15.
Figure 19:
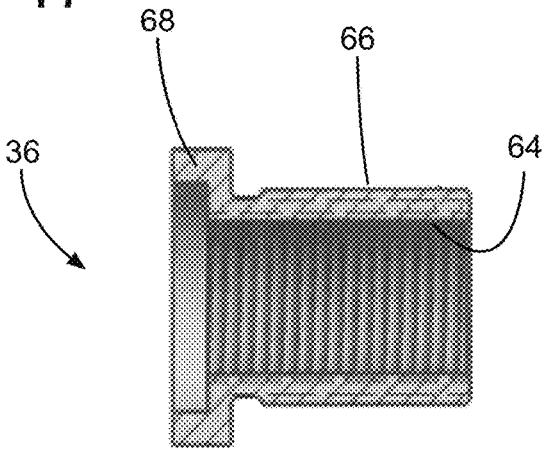
FIG. 19 is a cross-sectional view of the coupling of FIG. 15.

Several views of coupling 36 are provided in FIGS. 15-19. FIG. 15 is a perspective view of coupling 36, and FIGS. 16-18 provide side, first end, and second end views, respectively, of coupling 36. FIG. 19 is a cross-sectional view of coupling 36. As shown in the drawings, coupling 36 comprises a cylindrical component 62 including both internal threads 64 and external threads 66. Internal threads 64 are sized and configured to receive the external thread 12 of spark plug 10. External threads 66 are sized and configured to be received by the spark plug port of the aircraft engine. Coupling 36 also includes a flange portion 68 at one end. In the assembled form, spark plug 10 is threadingly received by coupling 36 with flange 68 received adjacent second end portion 54 of hex adapter 40.

Figure 20:
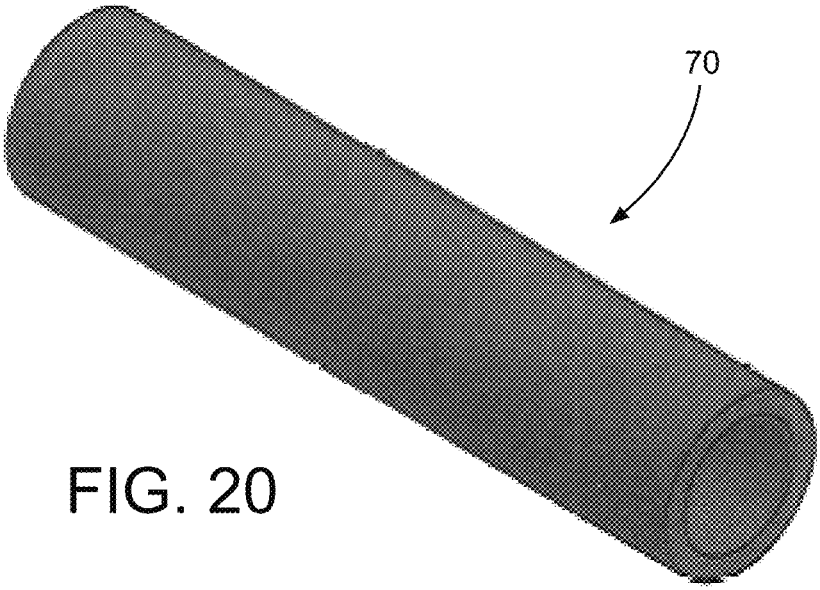
FIG. 20 is a perspective view of an illustrative insulator for surrounding a portion of the spark plug as disclosed herein.
Figure 21:
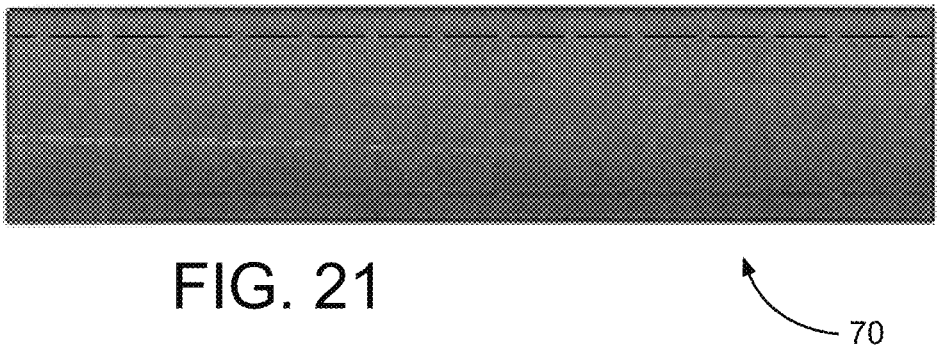
FIG. 21 is a side, elevational view of the insulator of FIG. 20.
Figure 22:
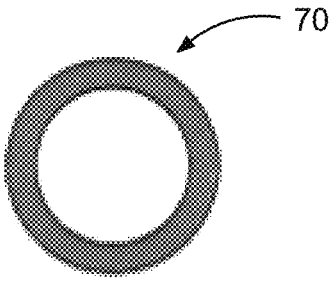
FIG. 22 is an end, elevational view of the insulator of FIG. 20.

An insulator 70 is shown in perspective in FIG. 20. Insulator 70 is sized and configured to surround portions of the spark plug received within sleeve 38. Insulator 70 may comprise a simple cylindrical component as shown in particular in FIGS. 21-22. Alternative forms of insulator 70 may be used. However, the cylindrical shape is preferred as it may be sized specifically to match the interior surface of sleeve 38. Insulator 70 may be formed from any material which serves to provide the desired electrical insulation, such as a dielectric phenol.

In an exemplary embodiment the invention combines a premium 14 mm, multi-channel automotive spark plug, with up to 4 electrodes, welded-in-place to an 18 mm spark-plug conversion coupling 36 to make it fully secure for high-vibration propeller aircraft operations. This assembly is then attached to a non-magnetic, metallic cylindrical member 42, preferably brass, which is further insulated and secured to eliminate radio-frequency interference. This is then connected to a standard aircraft ignition harness, a cable which receives an appropriate ignition impulse from the aircraft magneto (or similar starting device) to trigger the production of a spark.

The metallic and other parts may be machined or otherwise fabricated to the appropriate dimensions for either a short plug or a long plug application. In the preferred embodiment, sleeve 38 is non-magnetic, e.g. brass, and the hex adapter and cylindrical member are made from corrosion resistant metal, e.g. stainless steel, to prevent corrosion while in active use. Other metallic or non-metallic options may be utilized in other applications.

The spark plug assembly is suitably fabricated in a preferred embodiment as follows. Sleeve 38 is made of non-magnetic brass or another suitable material and is fabricated, e.g., machined, to the appropriate dimensions for either a long-plug or short plug to hold the 14 mm spark plug securely. Hex adapter 40, typically converting from ⅝ to ⅞ inches, is secured to sleeve 38 by suitable means, such as welding. Coupling 36 is threaded onto spark plug 10. The terminal nut end of spark plug 10 is then inserted into sleeve 38 to position the hexagonal flange of spark plug 10 within hexagonal-shaped cavity 60 of sleeve 10. Coupling 36, spark plug 10 and sleeve 38 are then joined together by induction brazing. This assembly is then pressure checked not to exceed 150 psi to assure there is no airflow leakage in the configuration. The appropriate heat range is also verified.

Finally, insulator 70 is pushed directly into the spark plug assembly between spark plug 10 and sleeve 38. Insulator 70 is sized to be received in an interference with the interior surface 48 of sleeve 38. The open end of sleeve 38 is closed upon attachment of the wiring harness to the spark plug assembly 32 by use of external thread 44.

A key objective of the invention is to produce sparks that minimize or eliminate fouling. It is well known that carbon fouling, MMT fouling and tetraethyllead fouling are common problems when these fuel components are combusted in a piston engine. Multi-day testing a wide range of plug designs on aircraft engines has revealed the unique outcome that the multi-electrode, multi-channel spark plug (either BKR6EQUA and BKR6EQUP) is the preferred plug design that best eliminates fouling in the aircraft. See chart below.

| SPARK PLUG ID | RATING | SPARK PLUG TEST RESULT |
|---|---|---|
| BKR5E1X-11 | Bad | Fouling noted |
| BKRSEKU | Good | No fouling over both days run |
| BKRSEKUP | Good | This is slightly better than the 5EKU's; Slight roughness on the first run but the mag drop was fine. Good non-fouling plug. |
| BKR6E1X-11 | Bad | Fouling noted |
| BKR6EGP | Bad | Misfiring noted |
| BKR6EKPB-11 | Bad | Fouling noted |
| BKR6EQUA | Best | No fouling faster idle speed, will recheck on day 2 |
| BKR6EQUA | Best | Day 2 very successful run with no fouling. Day 3 with the same results. |
| BKR6EQUP | Best | No fouling slight roughness (maybe weather, will recheck |
| BKR6EQUP | Best | Day 2 rerun of these plugs without cleaning was perfect with no RPM drop in the ignition system. No fouling. |
| BUE | Bad | Plug too cold; extensive fouling. |
| D-14 CHAMPION | Bad | Fouling noted, 18 MM plug for tractors, short reach, plug too cold |
| D-16 CHAMPION | Good | No fouling 18 MM tractor plug; short reach, tested the longest as aircraft flew with this plug on 4 flights and initially had 3 ground runs. |
| DIFR5SC11 | Bad | Fouling noted |
| EFR7WFTG | Bad | Fouling noted even after several re-gaps of plug tip clearance |

-continued

| SPARK PLUG ID | RATING | SPARK PLUG TEST RESULT |
|---|---|---|
| EM42 CHAMPION | Good | Aircraft plug (hotter than 40's); Idled rougher than automotive plugs |
| REM40E CHAMPION | Bad | Aircraft plug; Fouled; Lean mixture operation would not clean it up. Poor, no success. |

Testing trials were conducted over several months in a Cessna 150 aircraft. Weather conditions varied and the trials typically called for multi-day retests of each plug type to evaluate the outcomes for repeatability. The key verification point was the degree of lead or carbon fouling observed on each of the spark plugs after operation of the aircraft. The table above is a partial list of spark plugs that were evaluated for this trial. The BKR6EQU family of spark plugs was clearly the most effective of all the spark plugs tested. The spark plugs were not only clean of fouling, but also ran smoothly and started easily and received the highest satisfaction from the aircraft test pilot. The spark plugs were subsequently further tested on a Beechcraft 60 Duke with very similar results.

What is claimed is:

1. A spark plug assembly comprising:

a spark plug having an external mounting thread at one end and a pair of electrodes extending outwardly of the mounting thread, the spark plug further including a terminal at the opposite end, the spark plug also including a hexagonal flange for use in rotating the mounting thread to insert or remove the spark plug, and a top insulator positioned between the hexagonal flange and the terminal;

a housing comprising a sleeve having a first end defining an external thread sized and configured to couple with an ignition harness of a spark-ignited aircraft engine and a second end defining a hexagonal-shaped cavity sized and configured to receive the hexagonal flange of the spark plug, the top insulator and terminal of the spark plug being received within the sleeve and the hexagonal flange of the spark plug being received within the hexagonal-shaped cavity of the housing, the housing further defining an external hexagonal flange for use in securing the housing to the spark plug port of an aircraft engine;

a coupling secured to the housing and including an internal thread configured to receive the external mounting thread of the spark plug, the external mounting thread of the spark plug being threadingly received within the internal thread of the coupling, the coupling further including an external thread configured to be received by the aircraft engine; and an insulator received within the sleeve and surrounding the top insulator of the spark plug.

2. The spark plug assembly of claim 1 in which the housing has a cylindrical outer surface except at the location of the hexagonal flange.

3. The spark plug assembly of claim 1 in which the hexagonal flange of the housing is adjacent the second end of the housing.

4. The spark plug assembly of claim 1 in which the housing comprises an elongated, cylindrical member and a hexagonal converter attached to the cylindrical member and defining the hexagonal shaped cavity of the housing.

* * * * *